US007017288B1

(12) United States Patent
Megli

(10) Patent No.: US 7,017,288 B1
(45) Date of Patent: Mar. 28, 2006

(54) LEVELING SYSTEM FOR REVERSING ASSEMBLY

(75) Inventor: Phillip John Megli, Sterling, IL (US)

(73) Assignee: Bonnell Industries, Inc., Dixon, IL (US)

( * ) Notice: Subject to any disclaimer, the term of this patent is extended or adjusted under 35 U.S.C. 154(b) by 0 days.

(21) Appl. No.: 10/691,218

(22) Filed: Oct. 22, 2003

(51) Int. Cl.
*E01H 5/04* (2006.01)

(52) U.S. Cl. ..... 37/231; 37/234; 37/236; 37/266; 172/820; 172/829; 172/830

(58) Field of Classification Search ..... 37/231, 37/214, 234–236, 266, 267; 172/777–799.5, 172/810–831
See application file for complete search history.

(56) References Cited

U.S. PATENT DOCUMENTS 4,976,054 A * 12/1990 Jones ..... 37/235
5,121,562 A * 6/1992 Feller ..... 37/235

* cited by examiner

*Primary Examiner*—Christopher J. Novosad
(74) *Attorney, Agent, or Firm*—McDermott Will & Emery LLP

(57) ABSTRACT

A leveling system designed for use with a vehicle having a reversing assembly including a table, an A-frame and a swivel member. The reversing assembly may be rotatably mounted to the vehicle with a lifting mechanism designed to elevate the reversing assembly for transportation when not in use. The leveling system is rotatably mounted to the A-frame and stabilized with parallel bars which function to achieve leveling of the assembly. Two chains of equal length are fixed to opposite ends of the leveling system, each at an equal distance outward from the center of the system and each connected at its other end to the lifting member of the vehicle. The chains aid in the lifting and leveling of the system.

13 Claims, 5 Drawing Sheets

LEVELING SYSTEM FOR REVERSING ASSEMBLY

TECHNICAL FIELD

The present subject matter relates generally to a leveling system for equipment mounted to the front of a vehicle. More specifically, the subject matter relates to an automatic leveling system for reversing assembly equipment mounted to a vehicle, such as, for example, a snowplow.

BACKGROUND

The practice of removing snow from road surfaces and parking lots dates back many years, and is an ever increasing necessity today, as the number of miles of road increases. Snowplow equipment generally consists of the following six main components.

1. A blade to push snow to the side of the roadway or path. The blade usually has a wear bar bolted to its lower horizontal edge.

2. A table weldment to which the blade is attached.

3. An A-frame weldment to which the table is rotatably attached.

4. Linear actuators to rotate the table with respect to the A-frame, thus providing an automatic reversing assembly.

5. A means to attach the A-frame to the front of a motor vehicle.

6. A lift bar attached to the front of the motor vehicle to lift the snowplow assembly for transport.

The reversing assembly allows an operator to have the plow oriented in a straight position, discharge left position or discharge right position. In the straight position the plow blade is generally perpendicular to the direction of travel of the motor vehicle when viewed from above the vehicle. The straight position is also referred to as the bulldoze position. In the discharge left and discharge right positions, the plow blade is angled to the left or right, respectively, so as to move the snow to the left or right of the motor vehicle when the vehicle is moving in a forward direction.

In the typical arrangement, when the snowplow is lifted into a transport position for travel, the snowplow will tend to list to the side that it is angled. The problem is inherent in the geometry of the plow assembly. The center of gravity of the plow assembly moves towards the side of the vehicle to which the plow assembly is angled and causes the plow to drop to that side. Accordingly, the efficiency and the safety of the snowplowing assembly is negatively impacted. The negative effects include, but are not limited to the following.

1. The plow can list so far as to cause contact with the road surface and thereby damage the road surface or the plow.

2. The listing can also place the lower edge in the way of obstructions and cause the plow to "catch" on the obstructions causing damage to the plow and danger to the driver of the vehicle.

3. Most of these assemblies are carried with a chain or a cable that is slidably attached to the lift bar in such a way as to prevent efficient "reversing" of the plow while it is being carried in the transport position. Reversal in transport position causes significant stress to the chain or cable and the plow is subject to choppy and erratic movement. Consequently, the operator must set the plow down on the road surface to reverse it before raising the plow again for transport.

4. Listing of the plow to one side inherently causes the other side of the plow to rise. If the listing is severe, the plow can obstruct the driver's view.

5. Without a leveling device to hold the plow level, an operator can not carry the plow an inch or so off the ground while plowing in "soft conditions."

Level lift systems exist; however, these level lift systems suffer from the following significant drawbacks.

1. The entire mechanism, excluding the lift chains, resides under the table and A-frame, putting it close to the road surface and subject to snow and ice buildup, which causes failure of the mechanism.

2. The mechanism includes two sliding chain hookups attached to or part of the front member of the table. The sliding mechanism is subject to binding if not properly and frequently lubricated and maintained. Binding causes failure to the mechanism.

3. Maintenance of the unit is difficult because the mechanism is located underneath the table.

4. The mechanism only works with a fixed length lift bar and cannot be simply adjusted to work with different lengths. Accordingly, in order to adjust the level, the lift arm must have some mode of adjustment.

Other level lift systems incorporate a single lift chain fixed at one end to the lift and at the other end to a framework welded to the table. Although this design allows the plow to settle into a level position under ideal conditions, it fails to secure the plow in a stable level position when debris builds up on either end of the plow.

SUMMARY

The present subject matter relates generally to a leveling system for equipment mounted to the front of a vehicle. More specifically, the subject matter relates to an automatic leveling system for equipment mounted to a vehicle such as a snowplow.

It is one of the principal objectives of the present invention to provide a leveling system that provides for level operation of the plow assembly at all times.

Another objective is to provide a leveling system having no sliding mechanisms that may be jammed by debris.

A further objective is to provide a leveling system that incorporates rotating hinges residing on the top of a table to keep the hinges away from road debris.

Yet another objective is to provide a leveling device rotatably attached to an A-frame, not slidably attached to a table front beam.

Still another objective is to provide a leveling device that does not require positioning bars to achieve the side-to-side motion necessary for leveling.

Another objective is to provide a leveling device that requires little to no maintenance to operate consistently over an extended period of time.

Moreover, it is an objective to provide a leveling device that may be adjusted to achieve level lifting for various lengths of lift beams without modifying the lift beam in any way and without using cutting torches and welders.

Additional objects, advantages and novel features of the examples will be set forth in part in the description which follows, and in part will become apparent to those skilled in the art upon examination of the following and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION

The leveling system of the present invention is described herein with respect to a typical snow removal assembly. However, the leveling system may be utilized with any reversing assembly, such as, for example, other snow removal assemblies, broom assemblies, scraper assemblies, snow blowers, paving equipment, etc.

Figure 1A:
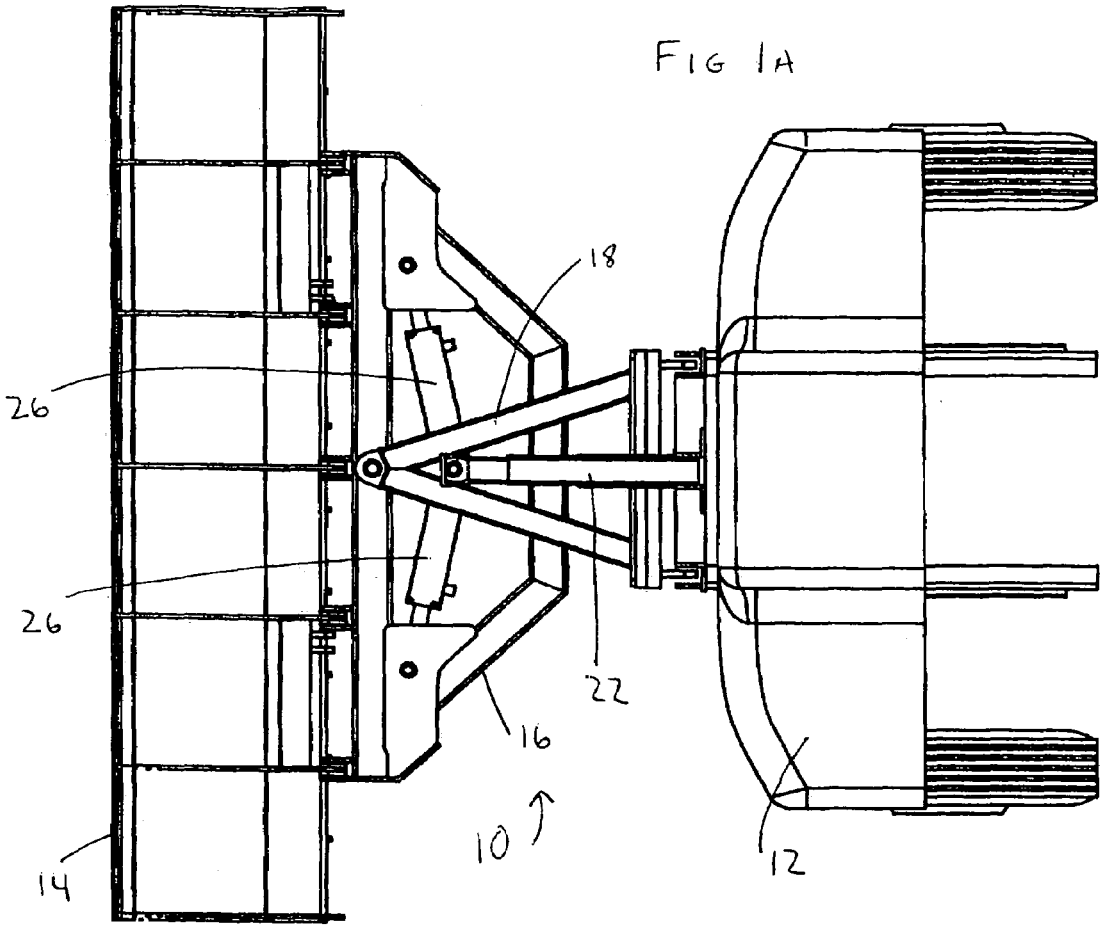
FIG. 1A is a plan view of a snowplow system.
Figure 1B:
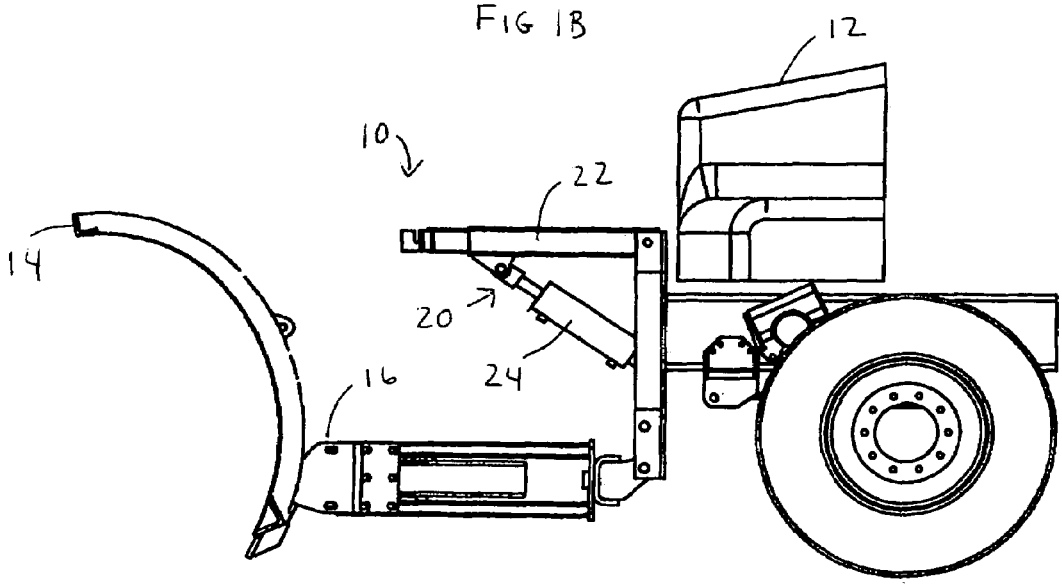
FIG. 1B is a side view of the snowplow system of FIG. 1A.

A typical snow removal assembly including a snowplow 10 mounted to a vehicle 12 is shown in FIGS. 1A and 1B. As shown in FIGS. 1A and 1B, the snowplow 10 includes a moldboard 14, a reversing table 16, a frame 18 and a lift arm assembly 20, including a lift arm 22 and linear lift arm actuator 24. Note that the frame 18 is described below and shown as an A-frame 18, however other frame sizes and shapes can be used as well. The snowplow 10 shown in FIGS. 1A and 1B is a typical snowplow 10. The moldboard 14 is rotatably mounted to the reversing table 16, which is in turn rotatably mounted to the A-frame 18, which is hingedly mounted to the vehicle 12. The moldboard 14, reversing table 16 and A-frame 18 may be lifted for transportation by the lift arm assembly 20 attached to the vehicle 12. The lift arm 22 is operated by the linear lift arm actuator 24. The reversing table 16 is reversed, or rotated, on the A-frame 18 by a pair of linear table actuators 26. The linear table actuators 26 allow the operator of the vehicle 12 to reverse the snowplow 10 between a left discharge, a bulldoze and a right discharge position as shown in FIGS. 4–9 and described further herein.

Figure 2:
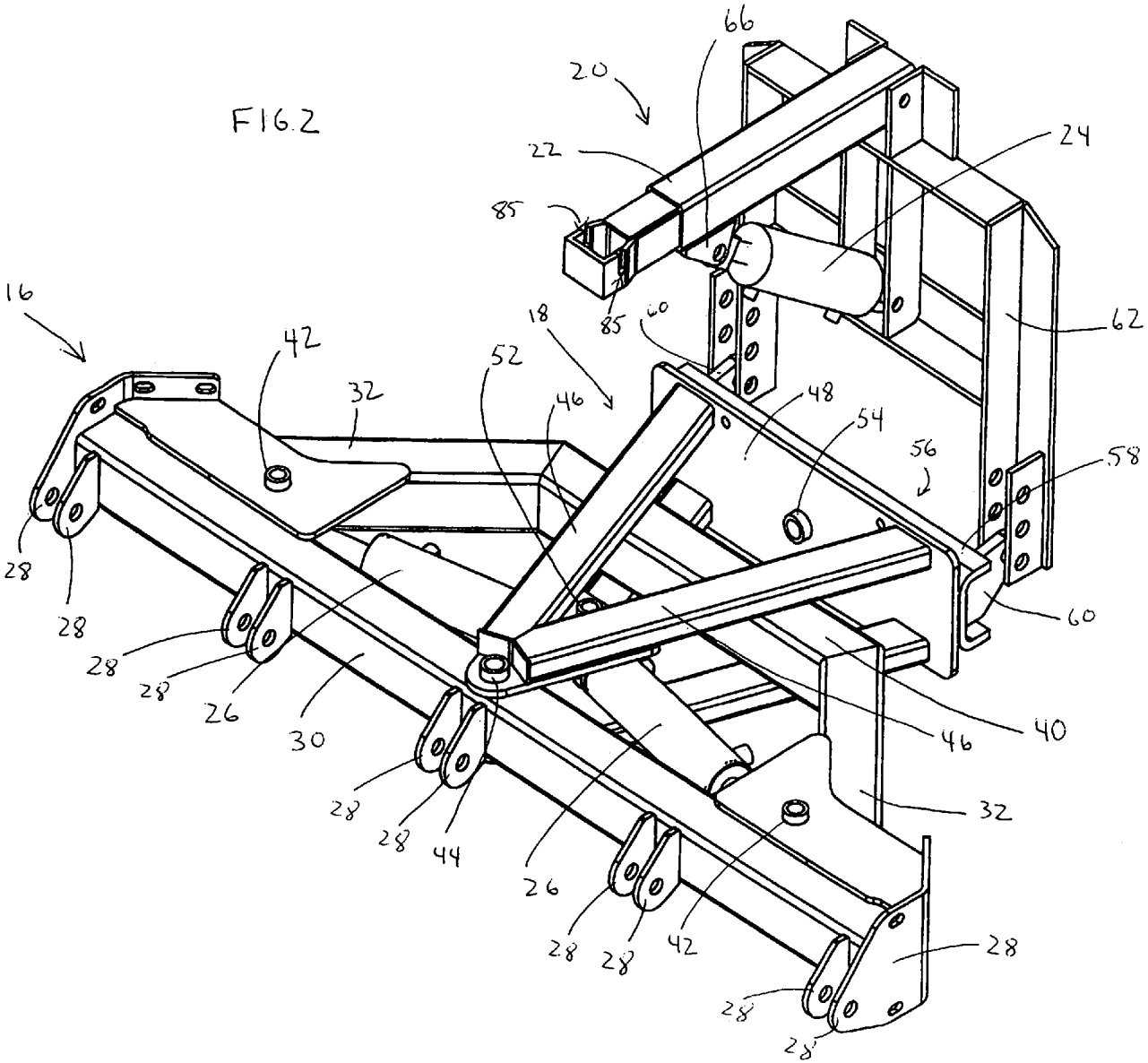
FIG. 2 is a perspective view of a reversing assembly.

The reversing table 16, A-frame 18 and lift arm assembly 20 are shown in FIG. 2. The reversing table 16 includes a set of hinge ears 28 for mounting the moldboard 14 to the reversing table 16, a front horizontal table beam 30, a pair of side table members 32, a pivot bushing 38, a rear table member 40 and a pair of hinge bushings 42 for mounting the first end of each of the linear table actuators 26.

As further shown in FIG. 2, the pivot bushing (not shown) of the reversing table 16 is rotatably attached to the A-frame 18 at an A-frame front bushing 44. In the configuration shown in FIG. 2, the pivot bushing is positioned within the A-frame front bushing 44. The A-frame 18 includes a pair of A-frame tube members 46, an A-frame rear plate 48, an A-frame top plate 50, an A-frame hinge bushing 52 for mounting the second end of each of the linear table actuators 26 and an A-frame rear swivel bushing 54. The reversing table 16 may rotate around an approximately vertical axis passing through the A-frame front bushing 44. As a result, the linear table actuators 26 operate to rotate the reversing table 16 around the A-frame front bushing 44, thereby rotating the snowplow 10 between the left discharge, the bulldoze and the right discharge positions, as shown in FIGS. 4–9.

As further shown in FIG. 2, the A-frame 18 is rotatably attached to a swivel bar 56 via the A-frame rear swivel bushing 54. The swivel bar 56 includes a swivel bar main beam 58 and a pair of swivel bar hookup ears 60. Thus, the A-frame 18 and reversing table 16 may rotate around an approximately horizontal axis passing through the A-frame rear-swivel bushing 54. The swivel bar 56 is further hingedly connected to the vehicle 12 along a vehicle frame 62 via the pair of swivel bar hookup ears 60, thereby allowing rotation of the swivel bar 56, the A-frame 18 and the reversing table 16 with respect to the vehicle 12. The swivel bar 56 and pair of swivel bar hookup ears 60 are merely one example of establishing freedom of rotation between the A-frame 18 and the vehicle 12. Alternatively, freedom of rotation between the A-frame 18 and the vehicle 12 may be accomplished using a ball and socket assembly, a dog and loop assembly, or other hinging or rotating means.

FIG. 2 further illustrates the lift arm assembly 20 attached to the vehicle frame 62. The lift arm assembly 20 includes a lift arm 22 hingedly attached to the vehicle frame 62 at a first end of the lift arm 22. The lift arm 22 includes a lift arm hinge ear 66 near a second end of the lift arm 22. A linear lift arm actuator 24 attaches the lift arm hinge ear 66 to the vehicle frame 62 such that the linear lift arm actuator 24 operates to rotate the lift arm 22 upwards and downwards to raise and lower the lift arm 22 with respect to the vehicle frame 62.

Figure 3:
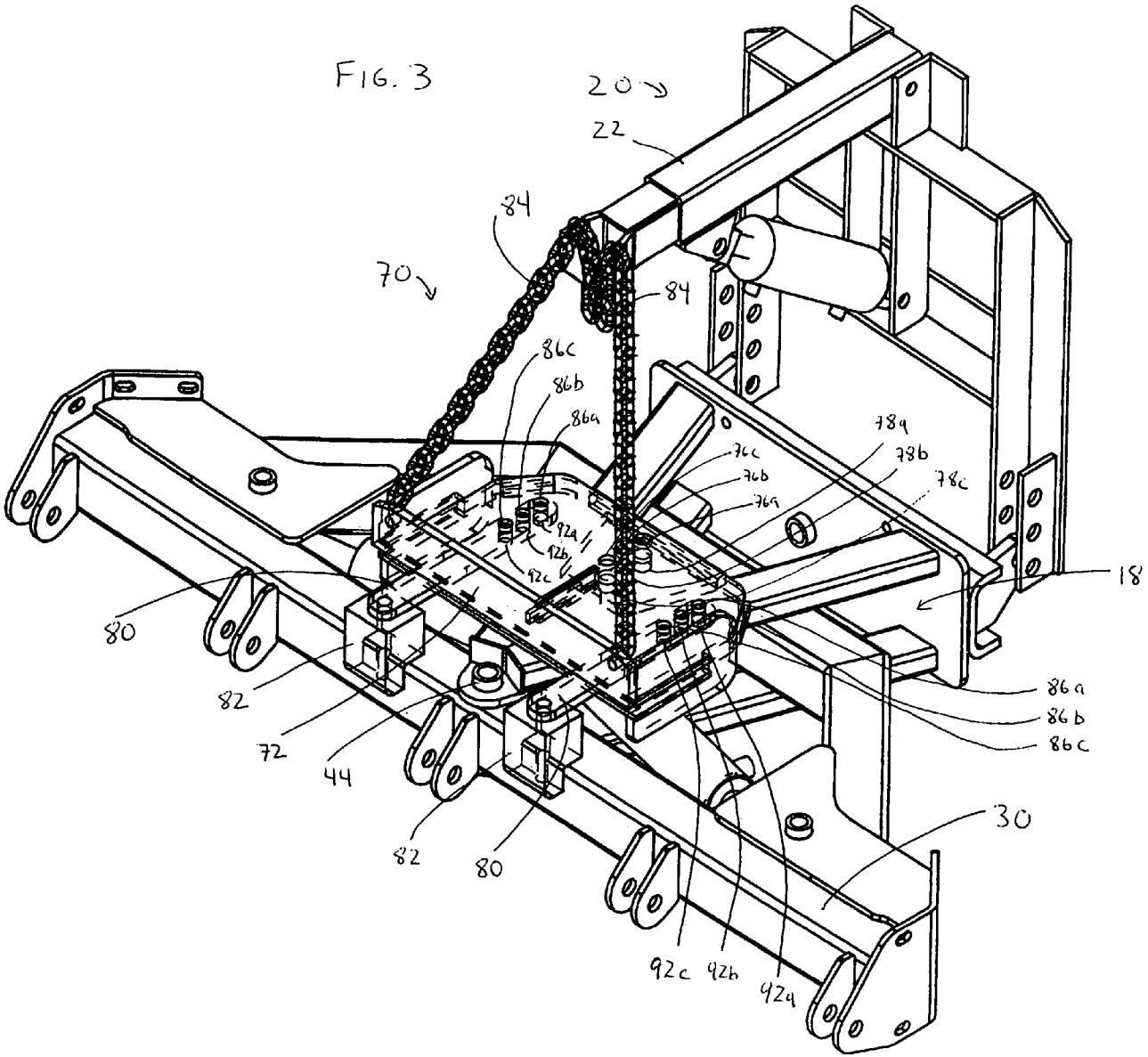
FIG. 3 is a perspective view of the reversing assembly of FIG. 2 further including a leveling system.

FIG. 3 shows a leveling carriage assembly 70 for coupling the lift arm assembly 20 to the A-frame 18. The leveling carriage assembly 70 includes a leveling carriage 72, which may be rotatably attached to a leveling base plate 74 between a leveling carriage hinge hole, either 76*a*, 76*b* or 76*c*, and a base plate hinge hole 78, either 78*a*, 78*b* or 78*c*. As shown, the attachment between the leveling base plate 74 and the A-frame 18 places the leveling carriage hinge holes 76*a*, 76*b* or 76*c*, a fixed distance relative to the A-frame front bushing 44. The leveling carriage assembly 70 further includes a pair of parallel bars 80, a pair of parallel bar anchors 82 and a pair of lift chains 84 attached to the lift arm assembly 20 at a pair of lift chain slots 85. The opposite ends of the pair of lift chains 84 are attached to the leveling carriage assembly 70. It is important to note that equal lengths of the pair of lift chains 84 are securely anchored at both ends and are not slidable. The lift chains 84 shown in FIG. 3 are attachment members for attaching the lift arm assembly 20 to the leveling carriage 70 and other types attachment members may be substituted in place of the lift chains 84. Further, the lift arm assembly 20 is not required to be located above the leveling carriage assembly 70 and may be repositioned, such as, for example, below or to the side of the carriage assembly 70.

In FIG. 3, the parallel bar anchors 82 are fixedly attached to the front horizontal table beam 30 at positions equidistant from the pivot point at the A-frame front bushing 44, where the reversing table 16 is rotatably attached to the A-frame 18. Although the pair of parallel bar anchors 82 are shown in FIG. 3 to be welded or otherwise fixedly attached to the horizontal table beam 30 using parallel bar anchors 82, the pair of parallel bars 80 may alternatively be attached to the reversing table 16 itself without the need for the parallel bar anchors 82, weldings or castings. The leveling base plate 74 is fixedly attached to the A-frame 18 and the leveling carriage 72 is rotatably attached to the leveling base plate 74. Further, the leveling carriage 72 is rotatably attached to the pair of parallel bars 80 at a pair of parallel bar hinging holes, either 92*a*, 92*b* or 92*c*, located at positions equidistant from the center of the leveling carriage 72, as well as equidistant from the parallel bar anchors 82. The pair of parallel bars 80 are also rotatably attached to the leveling carriage 72 through a pair of leveling carriage connecting holes, either 86*a*, 86*b* or 86*c*.

As shown in FIG. 3, the leveling base plate 74 and the parallel bars 80 include a series of base plate hinge holes 78*a*, 78*b* or 78*c* and a series of parallel bar hinging holes 92*a*, 92*b* or 92*c*, respectively. By varying which of the series of base-plate hinge holes and the series of parallel bar hinging holes are utilized, the degree of motion of the leveling carriage 72 around the A-frame front bushing 44 may be varied. The greatest degree of motion of the leveling carriage 72 is accomplished by using the base plate hinge hole 78*a* and the parallel bar hinging holes 92*a* located closest to the vehicle 12. Additional base plate hinge holes and bar hinging holes may be provided and utilized to further vary the degree of motion of the leveling carriage 72. Further, the series of plate hinge holes 78*a*, 78*b* and 78*c* and the series of parallel bar hinging holes 92*a*, 92*b* and 92*c* allows the leveling carriage 72 to be adaptable to reversing tables 16, A-frames 18, lift arm assemblies 20 of various sizes.

Figure 4:
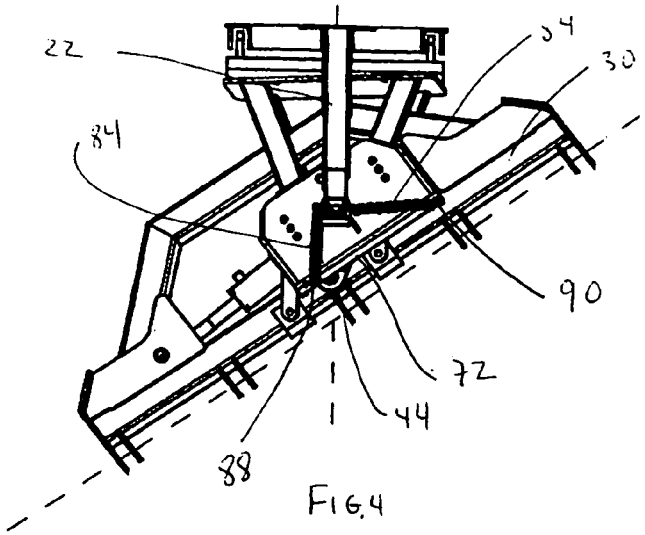
FIG. 4 is a plan view of the reversing assembly and leveling system of FIG. 3, wherein the table is reversed to the discharge left position.
Figure 5:
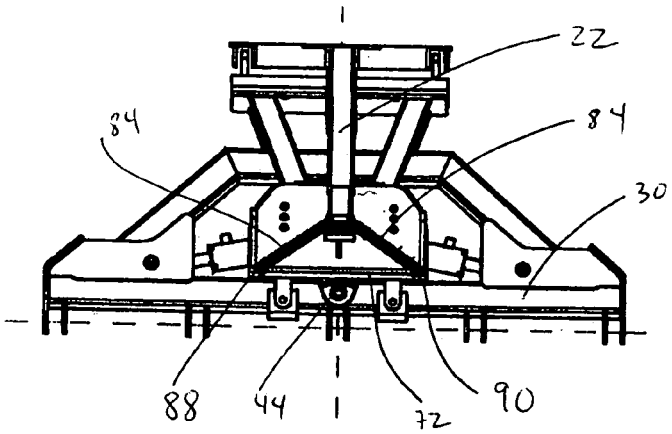
FIG. 5 is a plan view of the reversing assembly and leveling system of FIG. 3, wherein the table is in the bulldoze position.
Figure 6:
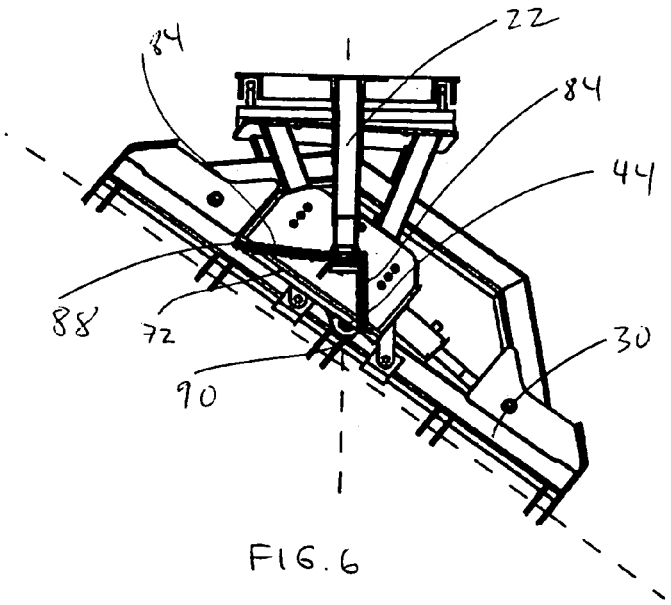
FIG. 6 is plan view of the reversing assembly and leveling system of FIG. 3, wherein the table is reversed to the discharge right position.
Figure 7:
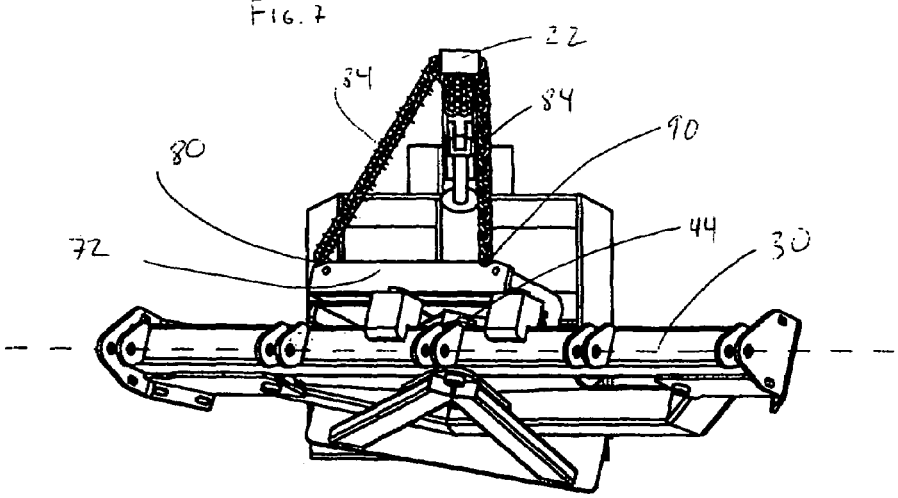
FIG. 7 is a front side elevation of the front of the reversing assembly and leveling system of FIG. 3 with the leveling assembly raised and in the discharge right position.
Figure 8:
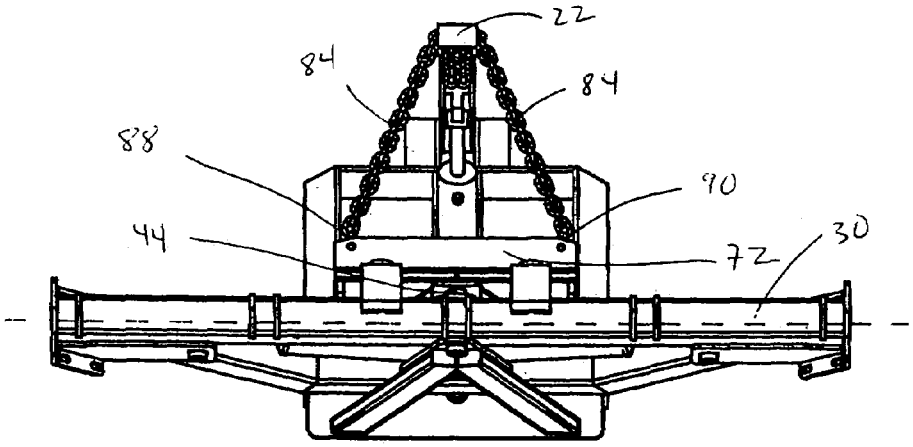
FIG. 8 is a front side elevation of the front of the reversing assembly and leveling system of FIG. 3 with the leveling assembly raised and in the bulldoze position.
Figure 9:
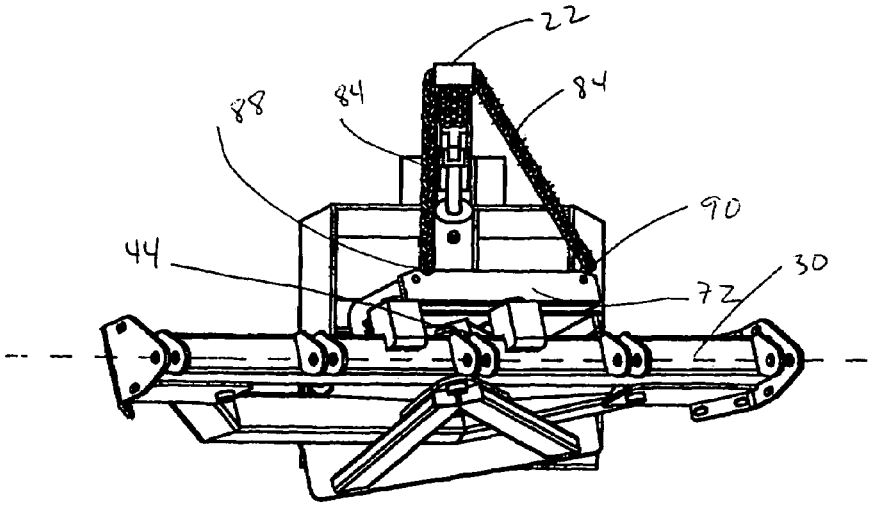
FIG. 9 is a side front side elevation of the front of the reversing assembly and leveling system of FIG. 3 with the leveling assembly raised and in the discharge left position.

The equal lengths of the pair of lift chains 84 and the equidistant positioning of both ends of the pair of parallel bars 80 from the A-frame front bushing 44 ensure the front horizontal table beam 30 will always be maintained parallel to ground level. Based on the geometry between the lift chains 84, the parallel bars 80 and the A-frame front bushing 44, when the linear table actuators 26 cause the reversing table 16 to rotate around the A-frame front bushing 44, the parallel bars 80 act upon the leveling carriage 72 such that the front edge of the leveling carriage 72, to which the lift chains 84 are attached, is maintained parallel to the front horizontal table beam 30. For example, when the snowplow 10 is reversed to the discharge right position as shown in FIGS. 6 and 7, a first hinge point 88 at which the left lift chain 84 attaches to the leveling carriage 72 moves closer to the A-frame front bushing 44 and a second hinge point 90 at which the right lift chain 84 attaches to the leveling carriage 72 moves further from the A-frame front bushing 44; however, the fixed length of the lift chains 80 ensures the leveling carriage 72 and the horizontal table beam 30 remain level, i.e., parallel to the ground. Further, movement of the lift arm 22 acts equally along both lift chains 84 thereby causing the horizontal table beam 30 to remain parallel to the ground at all times, including when the lift arm 22 is raised and lowered. Similarly, the horizontal table beam 30 remains parallel to the ground when the snowplow 10 is reversed to bulldoze position, as shown in FIGS. 5 and 8, the discharge left position as shown in FIGS. 4 and 9 or at any other position between the discharge left and discharge right positions.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A leveling system for a reversing assembly comprising:
- a lift arm assembly;
- a pair of lift chains attached at a first end of each lift chain to said lift arm assembly;
- a leveling carriage directly attached to a second end of each lift chain;
- a reversing table rotatably attached to said leveling carriage; and
- a frame rotatably attached to said reversing table and separately rotatably attached to said leveling carriage.

2. The leveling system of claim 1 further comprising actuator means for adjusting the angle of said reversing table with respect to said frame.

3. The leveling system of claim 1 wherein a first connector attaches said reversing table to said leveling carriage between a first position on said reversing table and a first position on said leveling carriage and a second connector attaches said reversing table to said leveling carriage between a second position on said reversing table and a second position on said leveling carriage, wherein the distance between said first position on said reversing table and said first position on said leveling carriage is equal to the distance between said second position on said reversing table and said second position on said leveling carriage.

4. The leveling system of claim 3 wherein said first connector and said second connector are a pair of parallel bars.

5. The leveling system of claim 3 wherein the distance between the point at which said leveling carriage attaches to said frame and the point at which said frame attaches to said reversing table is equal to the distance between said first position on said reversing table and said first position on said leveling carriage.

6. The leveling system of claim 1 wherein said leveling carriage attaches to said frame and said pair of attachment members at any of a plurality of positions.

7. The leveling system of claim 1 wherein said frame is an A-frame.

8. A leveling system for a reversing assembly comprising:
- a lift arm assembly;
- a pair of attachment members attached at a first end of each attachment member to said lift arm assembly;
- a leveling carriage directly attached to a second end of each attachment member;
- a reversing table rotatably attached to said leveling carriage; and
- a frame rotatably attached to said reversing table and separately rotatably attached to said leveling carriage, wherein a first connector attaches said reversing table to said leveling carriage between a first position on said reversing table and a first position on said leveling carriage and a second connector attaches said reversing table to said leveling carriage between a second position on said reversing table and a second position on said leveling carriage, wherein the distance between said first position on said reversing table and said first position on said leveling carriage is equal to the distance between said second position on said reversing table and said second position on said leveling carriage.

9. The leveling system of claim 8 further comprising actuator means for adjusting the angle of said reversing table with respect to said frame.

10. The leveling system of claim 8 wherein said first connector and said second connector are a pair of parallel bars.

11. The leveling system of claim 8 wherein the distance between the point at which said leveling carriage attaches to said frame and the point at which said frame attaches to said reversing table is equal to the distance between said first position on said reversing table and said first position on said leveling carriage.

12. The leveling system of claim 8 wherein said leveling carriage attaches to said frame and said pair of attachment members at any of a plurality of positions.

13. The leveling system of claim 8 wherein said frame is an A-frame.

* * * * *